US006572401B2

(12) United States Patent
Kurimoto et al.

(10) Patent No.: US 6,572,401 B2
(45) Date of Patent: Jun. 3, 2003

(54) CONNECTOR LOCKING MEMBER WITH DISENGAGEMENT FEATURE

(75) Inventors: Naoya Kurimoto, Yokkaichi (JP); Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/162,087

(22) Filed: Jun. 3, 2002

(65) Prior Publication Data

US 2002/0187673 A1 Dec. 12, 2002

(30) Foreign Application Priority Data

Jun. 6, 2001 (JP) ..... 2001-171026
Jun. 6, 2001 (JP) ..... 2001-171053

(51) Int. Cl.[7] ..... H01R 3/00
(52) U.S. Cl. ..... 439/489; 439/347
(58) Field of Search ..... 439/352, 304, 439/347, 15, 752, 595, 469, 188, 488, 368, 354, 345, 350, 358, 489, 351, 353, 305

(56) References Cited

U.S. PATENT DOCUMENTS 4,746,306 A * 5/1988 Yurtin et al. ..... 439/357
4,871,323 A * 10/1989 Ohsumi ..... 439/188
5,507,666 A * 4/1996 Yamanashi ..... 439/489
6,220,886 B1 4/2001 Kurimoto

* cited by examiner

*Primary Examiner*—Jean F. Duverne
(74) *Attorney, Agent, or Firm*—Gerald E. Hespos; Anthony J. Casella

(57) ABSTRACT

A connector has female and male housings (10, 20) that are connectable with one another. A recess (28) is formed in an outer surface of the male housing (20). A detector (40) is mounted in an initial position in the recess (28) before the housings (10, 20) are connected, and is moved to a detecting position after the housings (10, 20) are connected properly for preventing separation of the housings (10, 20). The detector (40) has a disengaging hole (46), a rotation permitting space (47) that communicates with the disengaging hole (46) and a catchable portion (48) facing into the rotation permitting space (47). A disengaging jig (60) has a disengaging portion (62) that can be inserted into the disengagement hole (46), rotated and pulled against the catchable portion (48) to move the detecting member (40) to the initial position.

14 Claims, 24 Drawing Sheets

CONNECTOR LOCKING MEMBER WITH DISENGAGEMENT FEATURE

BACKGROUND OF THE INVENTION

1. Field of the Invention

The present invention relates to a connector and to a method for disassembling the connector.

2. Description of the Related Art

A connector for an automotive wiring harness is disclosed in U.S. Pat. No. 6,220,886. This connector has a male housing with a receptacle into which a female housing is fittable. A detector is mounted sideways in the male housing and is movable between an initial and detecting positions. The housings can be connected and separated when the detector is in the initial position. However, the female housing has an interfering portion that interferes with the detector and prevents the detector from being pushed to the detecting position while the housings are being connected. The interfering portion is behind the detector when the housings are connected properly. Thus, the detector can be pushed to the detecting position, where the detector engages the rear of the interfering portion to lock the housings together. A connected state of the housings can be detected based on whether the detector can be pushed to the detecting position.

The housings are separated from each other by inserting a tool, such as a screwdriver, between the detector and the receptacle to return the detector to the initial position and then pulling the housings apart.

A high-voltage power supply system, such as a 42V power supply system, is being considered instead of a conventional 12V power supply system. However, an arc occurs when the connector of such a high-voltage power supply circuit is detached during the application of power. A conventional tool, such as a screwdriver, can move the detector of this connector. Thus, a user may erroneously detach the connector.

This invention was developed in view of the above problem, and an object thereof is to prevent a connector from being inadvertently detached.

SUMMARY OF THE INVENTION

The invention is directed to a connector with first and second engageable housings. A recess is formed in the first housing, and a restricting member can fit in the recess to engage the second housing and to prevent separation of the properly connected housings. The restricting member has a disengagement hole, a displacement permitting space that communicates with the disengagement hole and a catchable portion that faces into the displacement permitting space. The connector also comprises a disengaging jig that has a shaft and a disengaging portion that bulges transversely from the shaft. The disengaging portion of the jig is configured for insertion through the disengagement hole and into the displacement permitting space.

The housings are locked together by fitting the restricting member into the recess in the first housing to engage the second housing after the housings are connected properly. The housings are detached by inserting the disengaging jig into the disengagement hole, displacing the disengaging portion in the permitting space until it catches the catchable portion and then pulling the disengaging jig to disengage the restricting member from the second housing. The housings then can be separated from each other.

The permitting space and the catchable portion are at the bottom of the disengagement hole, and it is difficult to catch the catchable portion with a tool, such as a screwdriver, that has a straight shaft. Therefore, it is extremely unlikely that a person who does not possess the above-described special disengaging jig could inadvertently detach the connector.

The permitting space preferably permits displacement of the disengaging portion by inserting the disengaging jig into the disengaging hole and rotating the disengaging jig. The catchable portion preferably is formed by an edge of the disengagement hole. Thus, the restricting member is moved by displacing the disengaging portion in the permitting space up to a position where the disengaging jig catches the edge of the disengagement hole.

An opening area of the disengaging hole can be small as compared to a case where a slide groove is formed continuously with the disengaging hole and the catchable portion is caught by sliding the disengaging jig.

The disengaging jig can be held by holding means in a posture that enables the disengaging portion to catch the catchable portion. Thus, the restricting member can be moved easily. Furthermore, a loss of the disengaging jig can be avoided between the detachment and reconnection of the housings. Further, the disengaging jig can be held in the restricting member at the time of reconnection, to ensure that the operator does not forget to move the restricting member to engage the second housing.

The holding means preferably comprises a resilient lock for engaging the disengaging portion. The resilient lock is on a trace of displacement of the disengaging portion in the permitting space and is resiliently deformable only when a sufficient pushing force is given from the disengaging portion.

The resilient lock of the holding means preferably forms a semi-locking mechanism. Therefore, both a holding force for holding the disengaging jig and the operability of the disengaging jig can be attained easily.

The permitting space permits displacement of the disengaging portion in response to rotation of the disengaging jig in the disengagement hole.

The restricting member is moved by pulling the disengaging jig after the disengaging portion is displaced in the permitting space to a position where it catches the edge of the disengagement hole.

The holding means may comprise guiding means for guiding an interaction with the disengaging portion. The guiding means may comprise a slanted surface that contacts the disengaging portion during its displacement.

The invention also is directed to a method of disengaging first and second housings of a connector, wherein a restricting member is mountable into the first housing for engaging the second housing to prevent the properly connected housings from displacing. The method comprises inserting a disengaging jig into a disengagement hole in the restricting member. The method then comprises displacing the disengagement portion within a displacement permitting space that communicates with the disengagement hole, engaging the disengaging portion with a catchable portion that faces the displacement permitting space and moving the restricting member to a separation permitting position where the housings can be disengaged.

Accordingly, an opening area of the disengaging hole can be made smaller as compared to a case where a slide groove is continuous with the disengaging hole and where the disengaging jig is slid so that the disengaging portion can catch the catchable portion. Moreover, the disengagement operation is safer due to the necessity of a specified disengagement jig.

The disengaging portion preferably is displaced by rotating the disengaging jig in the disengagement hole.

Preferably, the disengaging jig is held in a posture that enables the disengaging portion to catch the catchable portion.

The disengaging jig preferably is held by resiliently engaging a resilient lock with the disengaging portion. The lock is arranged on a trace of displacement of the disengaging portion in the displacement permitting space.

These and other objects, features and advantages of the present invention will become more apparent upon reading of the following detailed description of preferred embodiments and accompanying drawings. It should be understood that even though embodiments are described separately, single features thereof may be combined to additional embodiments.

BRIEF DESCRIPTION OF THE DRAWINGS

FIGS. 23(A), 23(B) and 23(C) are partial plan views in section showing a process of rotating the disengaging jig, wherein FIG. 23(A) shows a state before the rotation, FIG. 23(B) shows a state during the rotation, and FIG. 23(C) shows a state after the rotation.

DETAILED DESCRIPTION OF THE PREFERRED EMBODIMENTS

A first embodiment of the connector of the subject invention is illustrated in FIGS. 1 to 13. The connector preferably is provided in a power supply circuit of a 42V power supply system mountable, for example, in an automotive vehicle. This connector is comprised of a female housing 10, a male housing 20, and a detector 40 for detecting a connected state of the housings 10, 20. In the following description, sides of the housings 10, 20 to be connected with each other are referred to as the front and reference is made to all the drawings except FIGS. 2 and 4 concerning the vertical direction.

Figure 1:
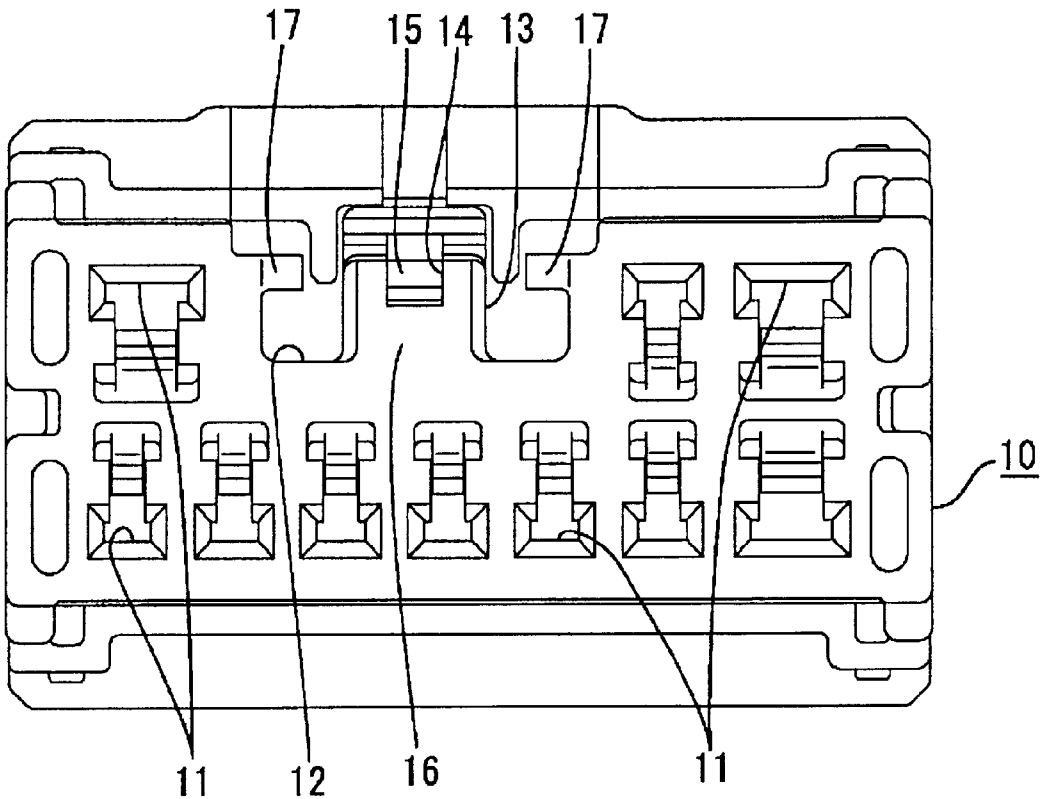
FIG. 1 is a front view of a female housing according to one preferred embodiment of the invention.
Figure 2:
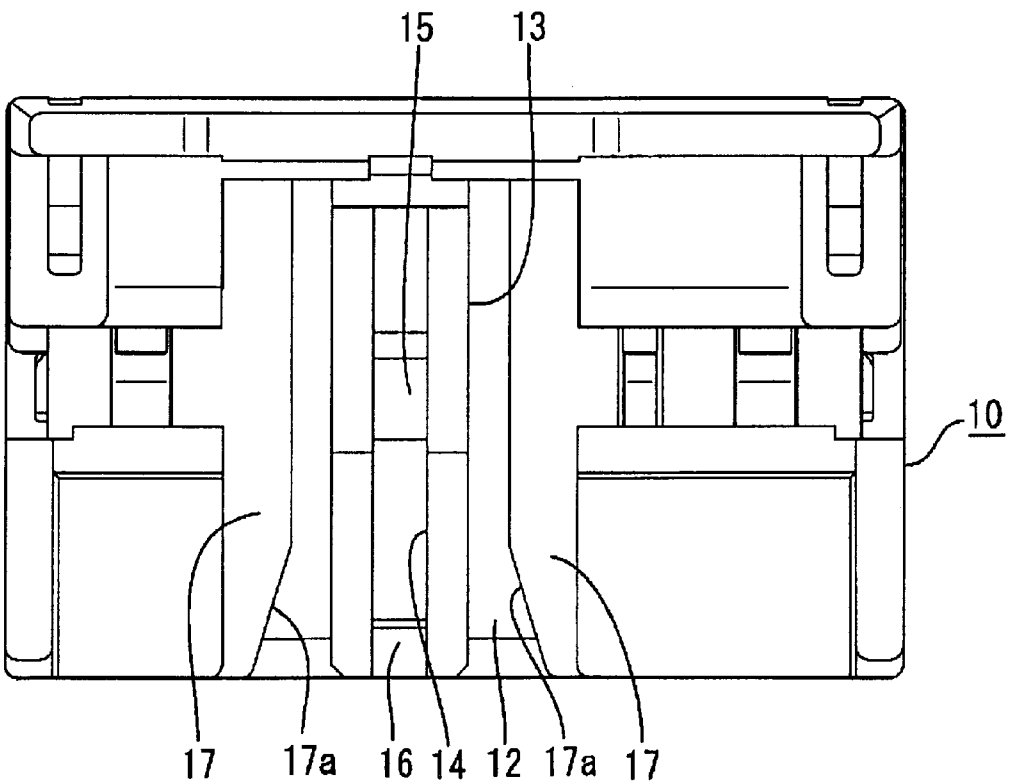
FIG. 2 is a plan view of the female housing.

The female housing 10 is made e.g. of a synthetic resin and has a substantially rectangular parallelepipedic shape, as shown in FIGS. 1 and 2. Seven cavities 11 are arranged side-by-side at a lower stage in the female housing 10 and three cavities are arranged side-by-side at an upper stage. Each cavity 11 is configured to receive an unillustrated female terminal fitting. A recess 12 is formed in the upper surface of the female housing 10 between the upper stage cavities 11 and extends forward and backward. A resiliently deformable lock arm 13 cantilevers from a substantially widthwise center of the recess 12. A slit 14 extends in forward and backward directions in substantially the widthwise center of the lock arm 13, and a lock 15 crosses the slit 14 at a middle position of the slit 14 with respect to forward and backward directions. A block-shaped interfering portion 16 projects at the front end of the lock arm 13 and crosses the slit 14. A pair of unlocking ribs 17 project toward the lock arm 13 from the opposite sides of the recess 12. The side surface of a front part of each unlocking rib 17 defines a slanted surface 17*a* that gradually slants away from the lock arm 13 and toward the front end of the unlocking rib 17.

Figure 3:
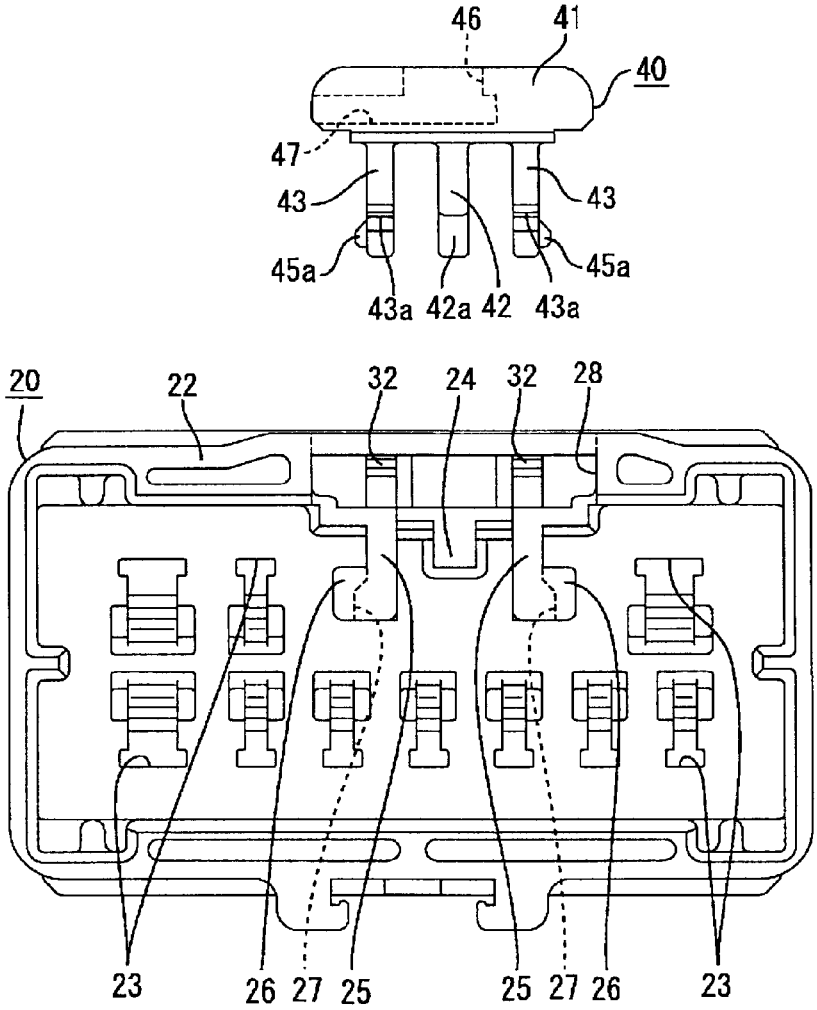
FIG. 3 is a front view of a male housing and a detector.
Figure 4:
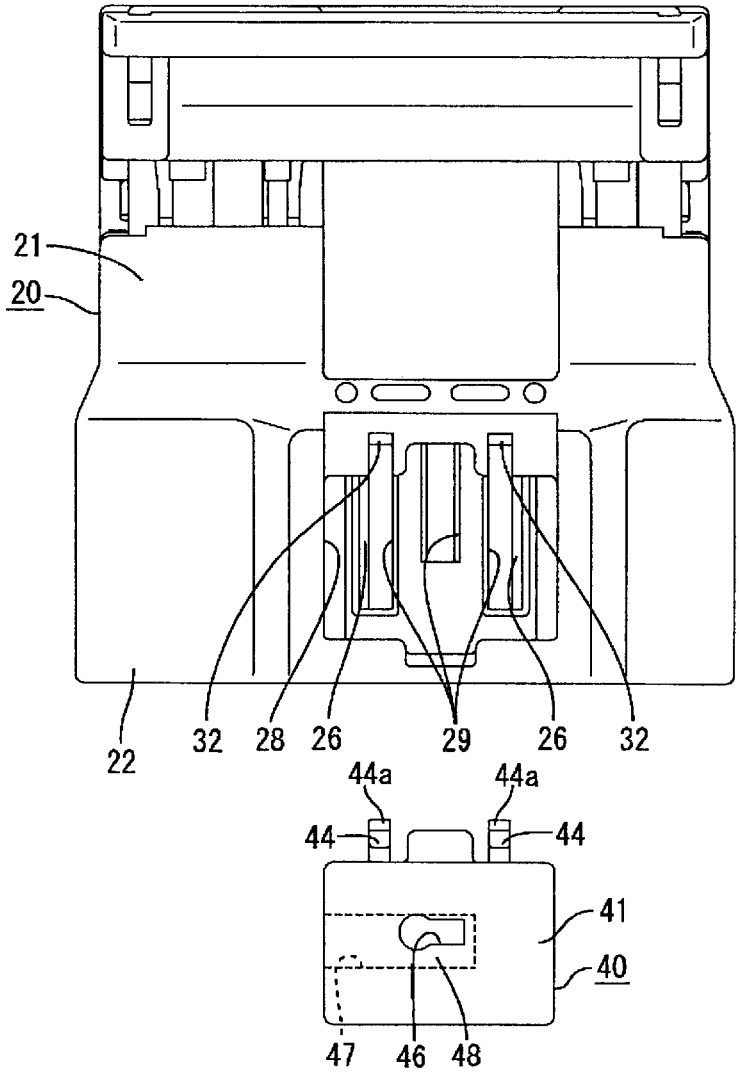
FIG. 4 is a plan view of the male housing and the detector.
Figure 5:
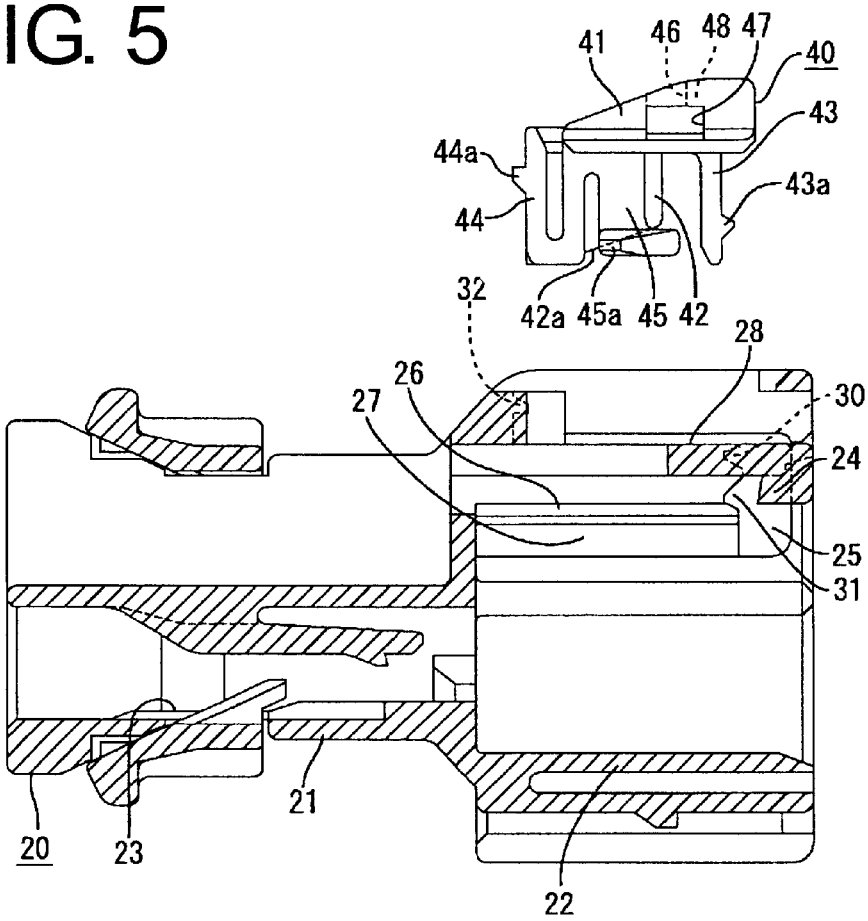
FIG. 5 is a side view in section of the male housing and the detector.

The male housing 20 is made e.g. of a synthetic resin and has a substantially rectangular parallelepipedic terminal accommodating portion 21 into which male terminal fittings (not shown) can be accommodated. A substantially rectangular tubular receptacle 22 projects forward, as shown in FIGS. 3 to 5. The terminal accommodating portion 21 has ten cavities 23, into which male terminal fittings are insertable at positions substantially corresponding to the respective cavities 11 of the female housing 10. The female housing 10 can be fit into the receptacle 22 from the front.

A lock 24 projects down from the front end of an upper part of the inner peripheral surface of the receptacle 22 and is engageable with the lock 15 of the lock arm 13. Support walls 25 in the form of rectangular columns project up to a position below the lock 24 at the left and right sides of the lock 24 in FIG. 3. Rails 26 in the form of substantially rectangular columns extend backward and are coupled to the outer side surfaces at the projecting ends of the support walls 25. The rails 26 have their rear ends connected with the back end surface of the receptacle 22. A lower part of the inner surface of each rail 26 defines an escape groove 27 that is open to the back. During the connection of the housings 10, 20, the lock arm 13 is inserted between the two supporting walls 25 and the unlocking ribs 17 are inserted above the rails 26.

A mount recess 28 is formed in the upper surface of the receptacle 22 and receives the detector 40. The mount recess 28 is formed by recessing part of the outer surface of the receptacle 22 and is substantially surrounded by front, rear, left and right walls. A mold-removal hole is formed in the front wall of the mount recess 28, but is closed by the female housing 10 (see FIG. 8) when the housings 10, 20 are connected properly. Three substantially side-by-side insertion slits 29 are formed in the bottom surface of the mount recess 28 and communicate with the inside of the receptacle 22. The insertion slits 29 extend forward and back, and the middle insertion slit aligns with the lock 24, while those at the opposite ends align with the supporting walls 25 and the rails 26.

The detector 40 is made e.g. of a synthetic resin, and has a substantially plate-shaped base 41 that is vertically movable into the mount recess 28. A rear part of the upper surface of the base 41 is sloped down and back. An engaging wall 42 projects at substantially the widthwise center of the bottom surface of the base 41, and front and rear lock arms 43, 44 project at the opposite sides of the engaging wall 42. A holding arm 45 projects between each pair of front and rear locks 43, 44. The engaging wall 42, the locking arms 43, 44 and the holding arms 45 are inserted through the respective insertion slits 29 of the mount recess 28 to enter the inside of the receptacle 22.

The engaging wall 42 is a substantially flat plate, and has a slanted bottom surface 42*a* that is sloped down and back from the front end. The engaging wall 42 also has an upright rear surface arranged substantially normal to the connecting direction. Each front locking arm 43 is a substantially rectangular column that projects straight down. A locking projection 43*a* projects forward from the bottom of the front locking arm 43, and slanted surfaces are formed on the upper and lower surfaces of the locking projections 43*a*. Each rear locking arm 44 is substantially U-shaped and has a bottom end bent like a hairpin. A locking projection 44*a* projects back from the projecting end of the rear locking arm, and a slanted surface is formed on the bottom of the locking projection 44*a*. The locking arms 43, 44 are resiliently deformable along forward and backward directions. Each holding arm 45 is a substantially L-shape with a bottom end that projects forward and an upper end connected with the rear locking arm 44. The holding arms 45 are resiliently deformable along the width of the female housing 10, and holding projections 45*a* project sideways from the outer side surfaces of the bottom ends thereof. Beveling is applied to the upper, lower and front surfaces of the holding projections 45*a*.

Figure 6:
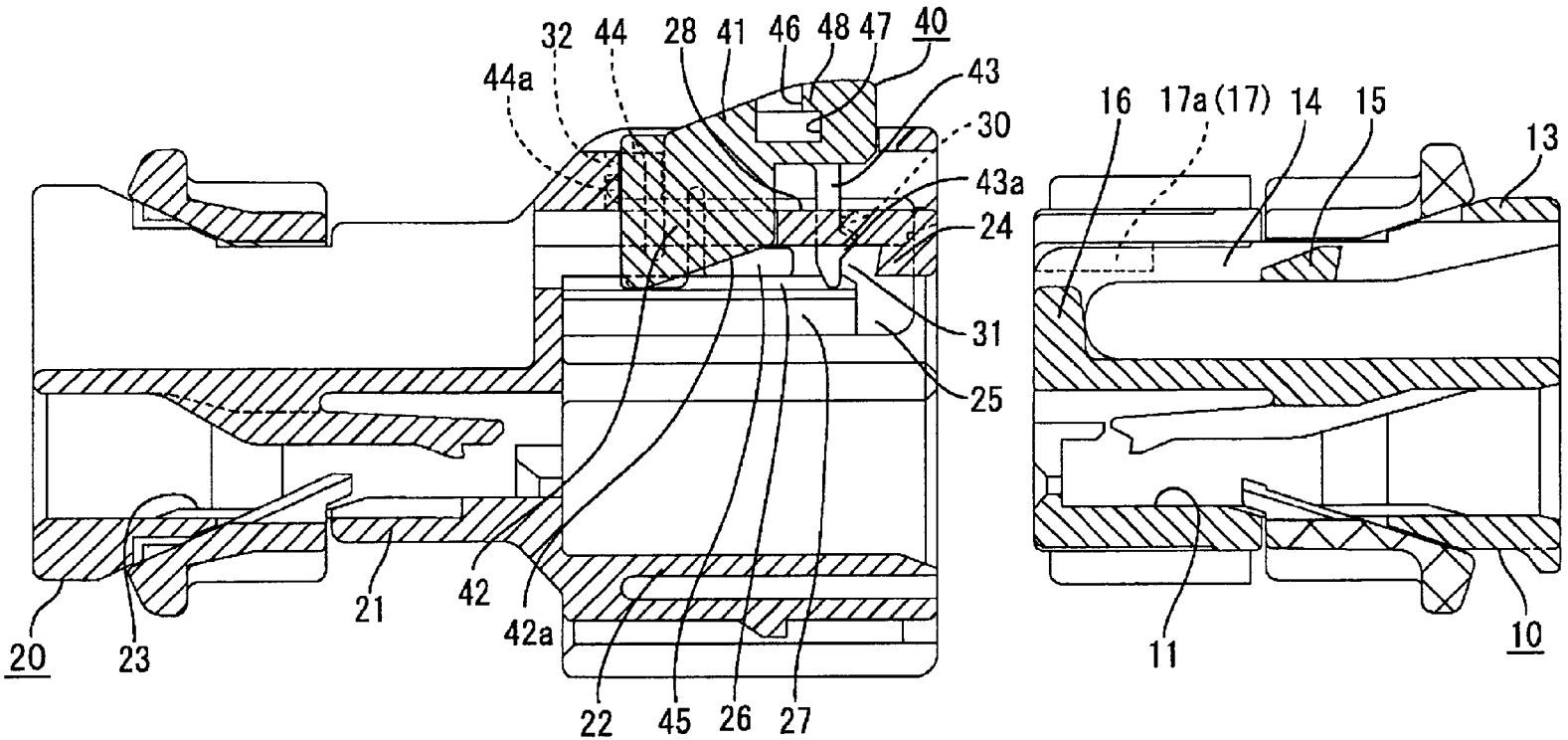
FIG. 6 is a side view in section of the male and female housings when the detector is mounted at an initial position.

The detector 40 is vertically movable in the male housing 20 between an initial position (see FIG. 6) where the base 41 projects up from the mount recess 28 and a detecting position (see FIG. 8) where the base 41 fits substantially completely in the mount recess 28. As shown in FIG. 6, the locking projections 43*a* of the front locking arms 43 initially are locked between corresponding vertically spaced front locking projections 30, 31 on the rear surfaces of the corresponding supporting walls 25. The locks 44*a* of the rear locking arms 44 engage the bottom surfaces of rear locking projections 32 on the rear surface of the mount recess 28; and the holding projections 45*a* of the holding arms 45 engage the upper surfaces of the rails 26. Thus, the detector 40 is held so as not to make loose vertical movements from the initial position. At this time, the engaging wall 42 is at a non-interfering position, and the interfering portion 16 of the female housing 10 permits the connection and separation of the two housings 10, 20. The unlocking ribs 17 of the female housing 10 are engageable from the front with the holding projections 45*a* that engage the upper surfaces of the rails 26.

Figure 8:
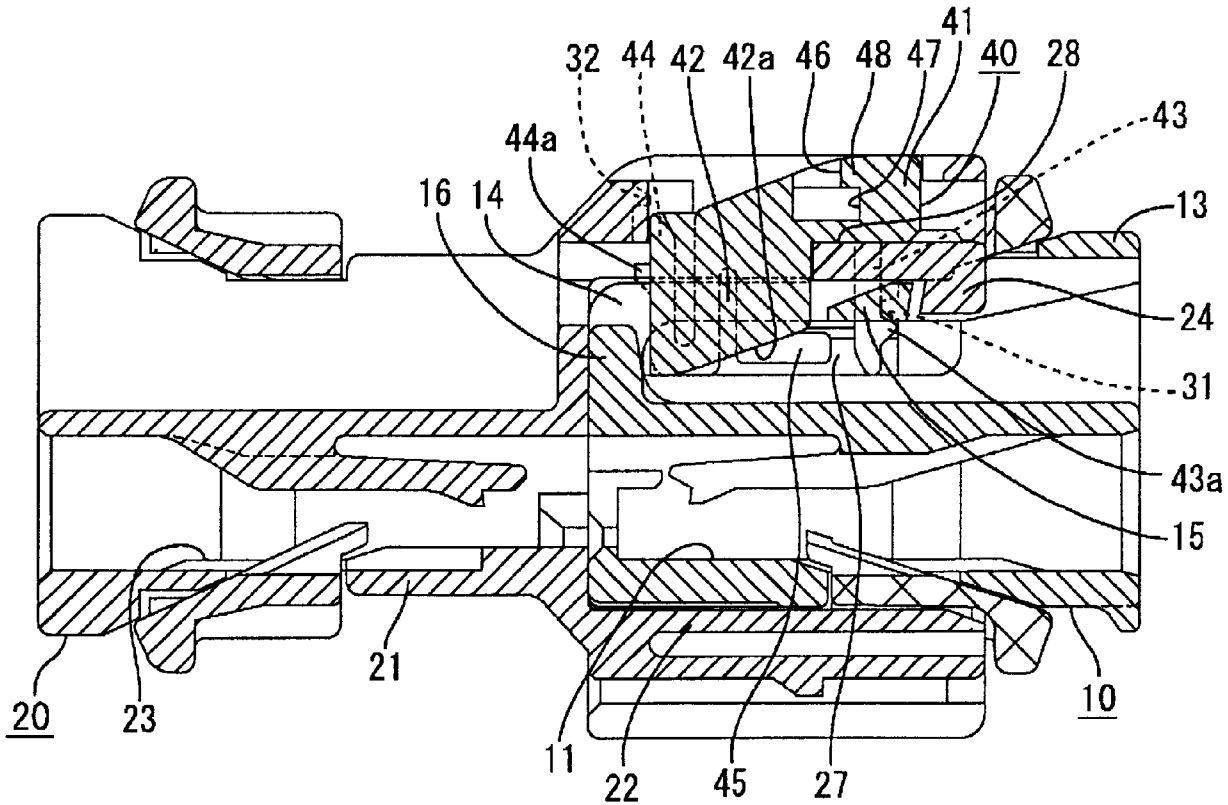
FIG. 8 is a side view in section showing a state where the housings are connected properly and the detector is pushed to a detecting position.

At the detecting position, the lower surface of the base 41 contacts the bottom surface of the mount recess 28 and the locking projections 43*a* of the front locking arms 43 engage the lower surfaces of the front locking projections 31 at the lower side, as shown in FIG. 8. Thus, the detector 40 will not make loose vertical movements from the detecting position. Further, the holding projections 45*a* align with the escape grooves 27 of the rails 26 so that the holding arms 45 resiliently restore toward their original shape (see FIG. 3). With the two housings 10, 20 properly connected with each other, the engaging wall 42 enters the slit 14 between the interfering portion 16 and the lock 15 of the lock arm 13 and engages the rear surface of the interfering portion 16 to prevent the properly connected housings 10, 20 from separating.

Figure 9:
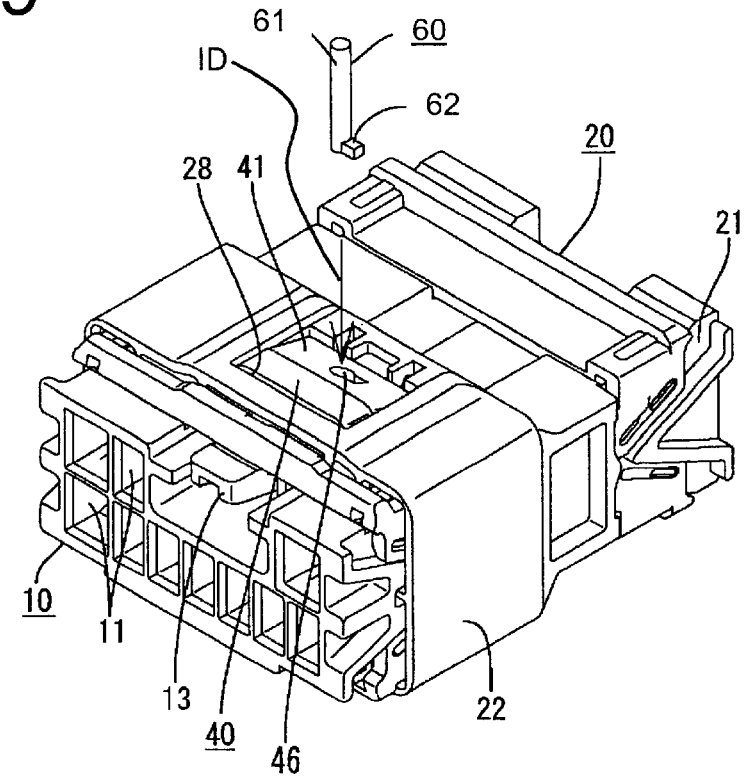
FIG. 9 is a perspective view showing a state before a disengaging jig is inserted into a disengagement hole.

A disengagement hole 46 is formed in the upper surface of the base 41, as shown in FIG. 9, and receives a disengaging jig 60 to operate the detector 40 in the mount recess 28. The disengagement hole 46 is at a center position of the upper surface of the base 41 and extends to a specified depth in the base 41 along an insertion direction ID of a shaft 61 of the disengaging jig 60. As shown in FIG. 4, the disengagement hole 46 has a key-hole shape that conforms to the leading end of the disengaging 60, and includes a substantially round portion at the left side and a substantially rectangular portion at the right side. The disengaging jig 60 is hook-shaped and has a rectangular disengaging portion 62 that projects sideways from the leading end of a cylindrical shaft 61, as shown in FIG. 9. This disengaging jig 60 normally is accommodated in a connector (not shown) that turns on and off a power supply from a battery.

A rotation permitting space 47 is formed in the left side of the base 41 in FIGS. 3 and 4 and communicates with the disengaging hole 46. The rotation permitting space 47 is a substantially rectangular hole in the side view of FIG. 5 and a panel of the base 41 lies below the rotation permitting space 47. As shown in FIG. 4, the rear surface of the rotation permitting space 47 is aligned with the rear end of the disengagement hole 46, while the front surface thereof is located more forward than the disengaging hole 46. The depth of the rotation permitting space 47 is equal to or larger than that of the disengaging portion 62.

The disengaging jig 60 can be inserted into the disengagement hole 46 and reaches the lower surface of the base 41. Thus, the disengaging portion 62 is accommodated in the rotation permitting space 47 and can be displaced in response to a clockwise rotation of the disengaging jig 60 in FIG. 10, (see FIG. 11). The lower front edge of the disengaging hole 46 then is caught by the upper surface of the disengaging portion 62 (see FIG. 13). As a result, the detecting member 40 can be pulled up from the detecting position where the housings 10, 20 are locked together to the initial position where the housings 10, 20 can be detached from each other. This front edge of the disengaging hole 46 serves as a catchable portion 48.

As shown in FIG. 6, the detector 40 fits in the mount recess 28 of the male housing 20 and is held at the initial position by the front and rear locking arms 43, 44 and the holding arms 45. The two housings 10, 20 are connected together after being e.g. connected with ends of separate harnesses. The connecting operation could be performed with the detector 40 pushed to the detecting position instead of the initial position. However, the detector 40 is pushed back automatically to the initial position as the connecting operation is performed due to the sliding contact of the interfering portion 16 with the slanted surface 42*a* of the engaging wall 42 projecting into the receptacle 22.

Figure 7:
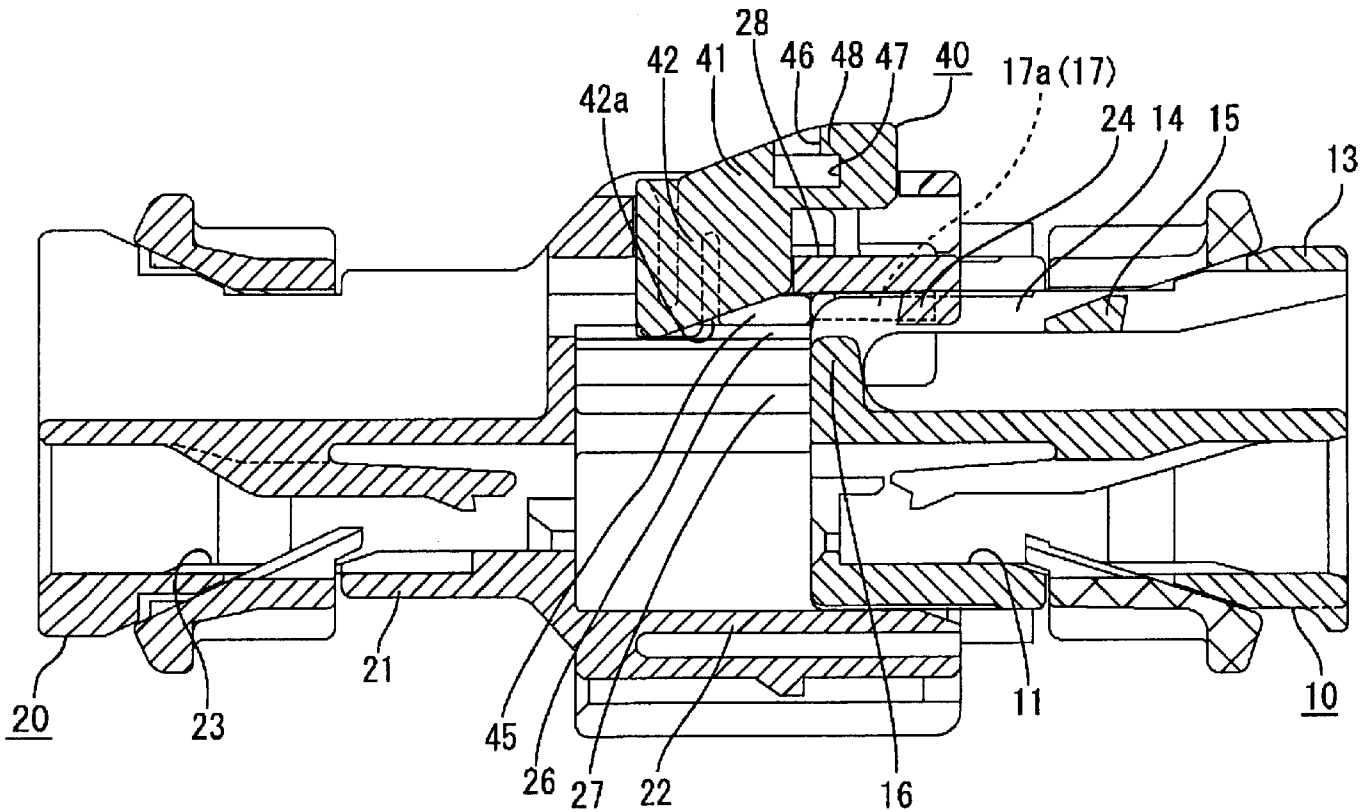
FIG. 7 is a side view in section showing an intermediate state of connection of the two housings.

The lock 24 enters the slit 14 of the lock arm 13 and the unlocking ribs 17 move above the rails 26 as the female housing 10 is fit into the receptacle 22 of the male housing 20. The holding arms 45 and the front locking arms 43 prevent an attempt to push the detector 40. As the connecting operation proceeds, the interfering portion 16 moves below the engaging wall 42 and the unlocking ribs 17 engage the holding projections 45*a* that are engaged with the upper surfaces of the rails 26, as shown in FIG. 7. The holding arms 45 then are pressed by the unlocking ribs 17 and are deflected laterally until the holding projections 45*a* disengage completely from the rails 26. An attempt to push the detector 40 toward the detecting position at this stage is prevented by contact of the engaging wall 42 with the upper surface of the interfering portion 16.

As the connecting operation proceeds further, the lock 24 engages the lock 15 of the lock arm 13 and causes the lock arm 13 to deflect resiliently down. The lock 15 reaches the rear side of the lock 24 when the housings 10, 20 are fit to a specified depth. Thus, the lock arm 13 is restored resiliently towards its original shape and the rear surface of the lock 15 engages the rear surface of the lock 24. As a result, the two housings 10, 20 are locked together. At this time, the detector 40 is pushed down from the original position, and the engaging wall 42 enters between the interfering portion 16. Additionally, the lock 15 and the front locking arms 43 are deformed resiliently and move onto the front locking projections 31 at the lower side. When the detector 40 reaches the detecting position, the engaging wall 42 engages the rear surface of the interfering portion 16. Additionally, the front locking arms 43 are restored so that the upper surfaces of the locking projections 43*a* engage the lower side of the front locking projections 31, as shown in FIG. 8. At this stage, the base 41 is substantially completely accommodated in the mount recess 28 and the upper end surface thereof is substantially flush with the outer surface of the receptacle 22. The lock arm 13 and the engaging wall 42 redundantly prevent the housings 10, 20 from separating.

A connected state of the housings 10, 20 is detected based on whether the detector 40 can be moved to the detecting position. Moreover, the detector 40 in the detecting position (FIG. 8) engages the interfering portion 16 from behind to prevent separation of the housings 10, 20.

The housings 10, 20 may have to be disconnected for maintenance or other reasons. This is accomplished by first detaching the connector (not shown) for turning on and off the power supply from the battery so that power to the power supply circuit is stopped. The disengaging jig 60 accommodated in this connector then is taken out and is maneuvered to operate the detector 40 that locks the housings 10, 20 together.

Figure 10:
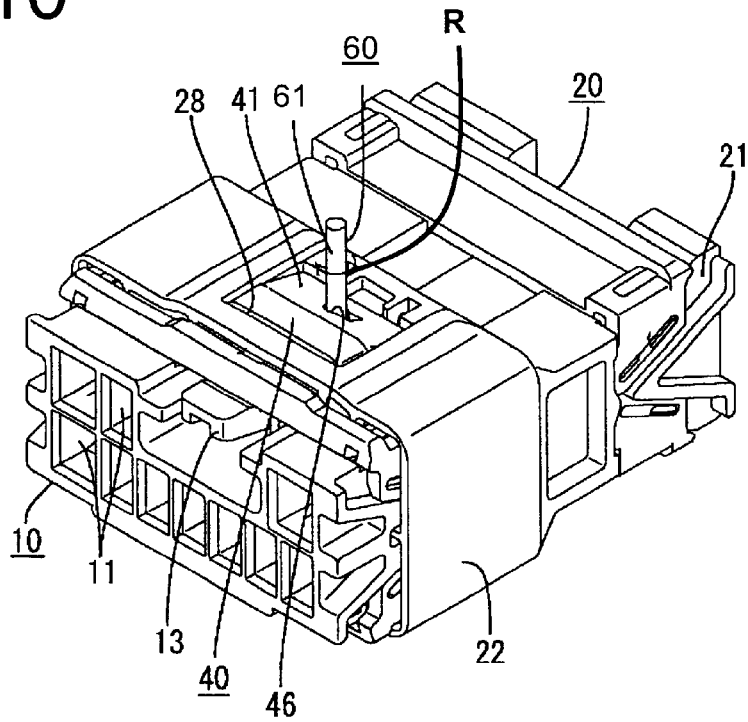
FIG. 10 is a perspective view showing an action of rotating the disengaging jig inserted into the disengagement hole.
Figure 11:
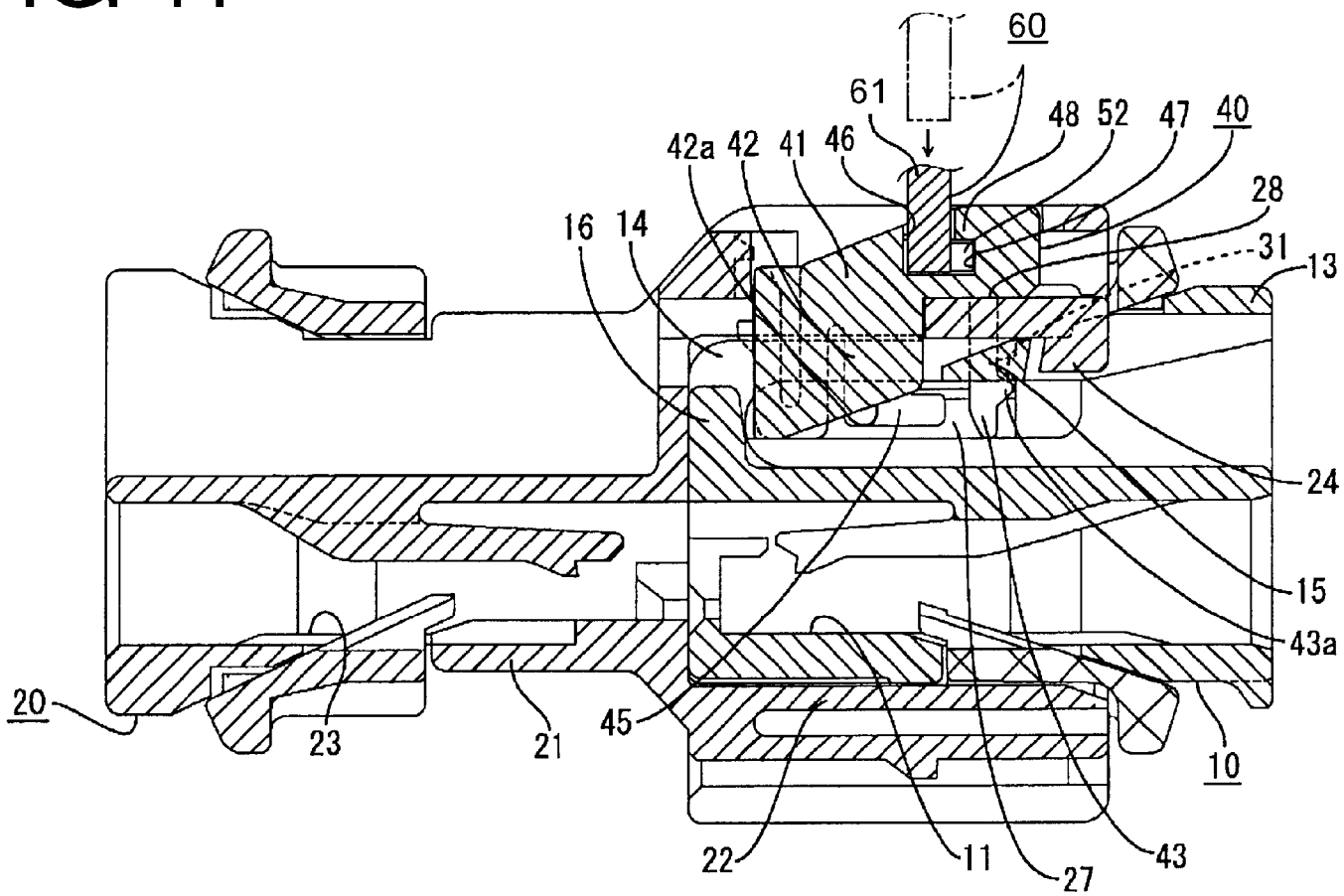
FIG. 11 is a side view in section showing an operation of catching a catchable portion by the disengaging portion.
Figure 12:
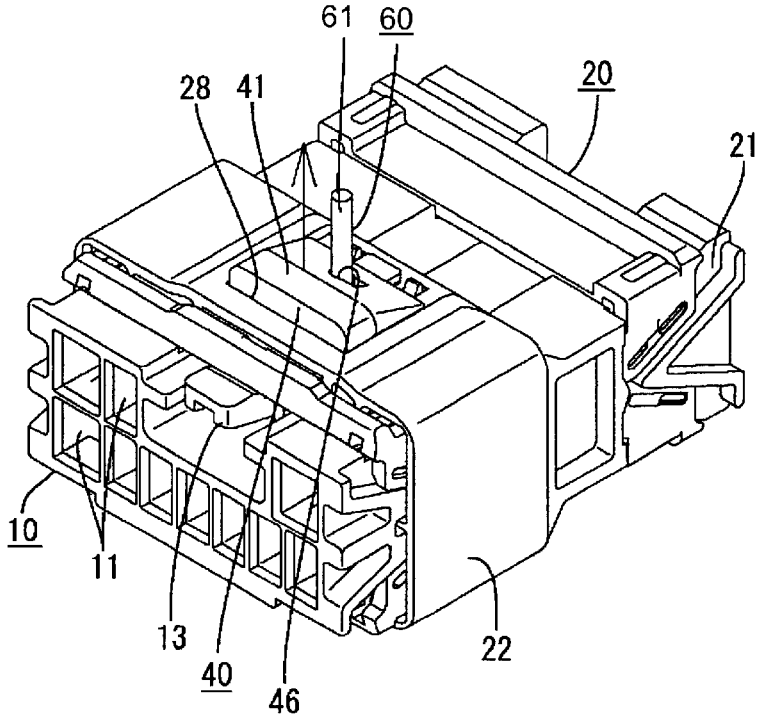
FIG. 12 is a perspective view showing a state where the detector is pulled up to the initial position by the disengaging jig.
Figure 13:
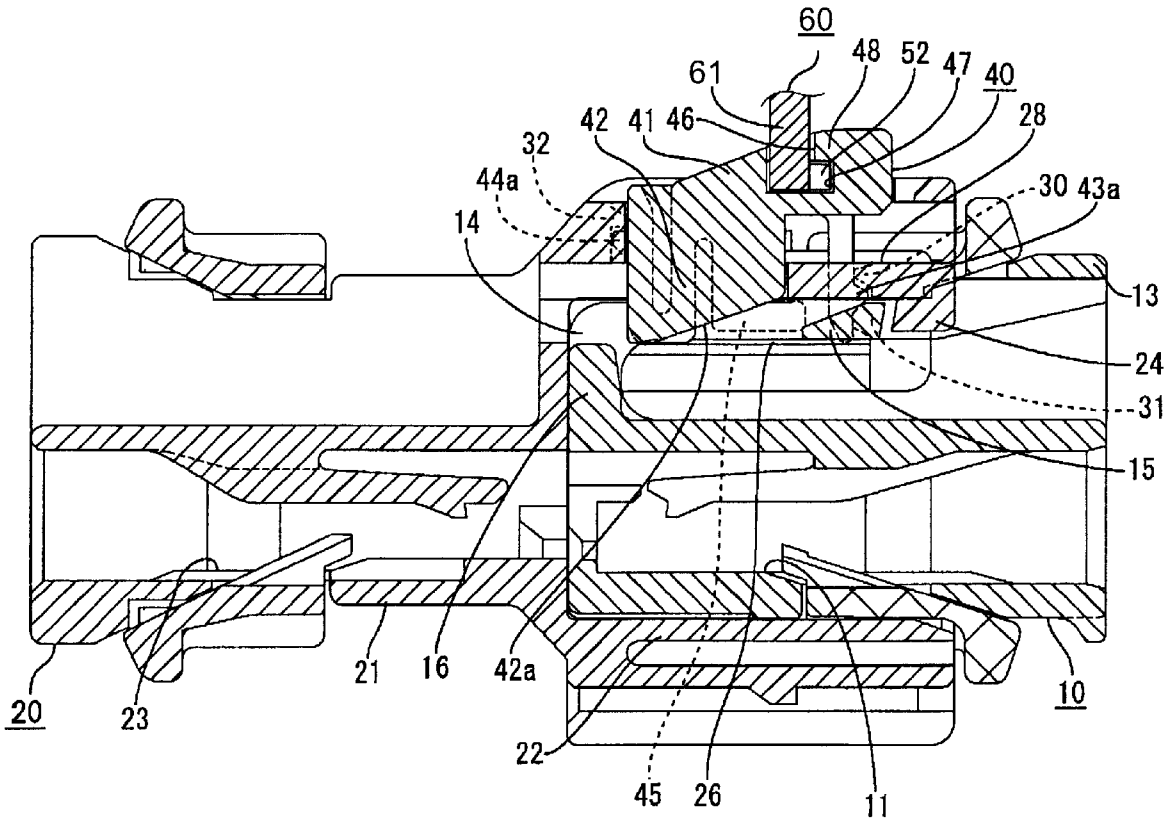
FIG. 13 is a side view in section showing the state where the detector is pulled up to the initial position by the disengaging jig.

The detector 40 is moved by inserting the leading end of the disengaging jig 60 into the disengaging hole 46, as shown in FIG. 9, until the leading end surface of the disengaging portion 62 contacts the bottom surface of the disengaging hole 46. The inserted disengaging jig 60 then is rotated clockwise about the longitudinal axis of the shaft 61 as shown in FIG. 10. Thus, the disengaging portion 62 is displaced in the rotation permitting space 47 to a position where it is not aligned with the disengaging hole 46 and hence faces the catchable portion 48, as shown in FIG. 11. The disengaging jig 60 then is pulled up so that the upper surface of the disengaging portion 62 catches the catchable portion 48 as shown in FIGS. 12 and 13. As a result, the detecting member 40 is pulled up to the initial position. During this process, the front locking arms 43 are deformed as the locking projections 43*a* move onto the lower sides of front locking projections 31, and the holding arms 45 are deformed as the holding projections 45*a* move onto the rails 26. When the detector 40 reaches the initial position, the engaging wall 42 is retracted to the non-interfering position above the interfering portion 16. Thus, the interfering portion 16 and the engaging wall 42 are disengaged. The two housings 10, 20 can be pulled in separating directions and detached while the lock arm 13 is deformed to disengage the lock 15 and the lock projection 24 from each other.

As described above, the rotation permitting space 47 communicates with the bottom of the disengaging hole 46 along the direction ID of the shaft 61 of the disengaging jig 60 and the edge of the disengaging hole 46 facing the rotation permitting space 47 serves as the catchable portion 48. Thus, it is difficult to catch the catchable portion 48 using a usual tool having a straight shaft, such as a screwdriver, and a person who does not possess the special disengaging jig 60 is unlikely to detach the connector inadvertently. Further, the disengaging jig 60 cannot be taken out unless the power supply circuit is turned off. Hence, the connectors will not be detached during the power application, and accordingly an arc can be prevented.

The disengaging portion 62 can catch the catchable portion 48 by rotating the disengaging jig 60. Thus, an opening area of the disengaging hole 46 can be made small as compared to a case where a slide groove continuous with the disengaging hole is formed and the catchable portion is caught by the disengaging portion by sliding the disengaging jig 60.

A second embodiment of the invention is described with reference to FIGS. 14 to 25. In this embodiment, the detector has a different configuration than the previous embodiment. The other elements are similar to or the same as the first embodiment, and are not described. Rather, these similar or identical elements merely are identified by the same reference numerals.

The detector 40 is made e.g. of a synthetic resin, and has a plate-shaped base 41 that is vertically movable in the mount recess 28. An upper rear surface of the base 41 is sloped down to the back. An engaging wall 42 projects at the widthwise center of the bottom surface of the base 41. A pair of front and rear locking arms 43, 44 are provided at each of the opposite sides of the engaging wall 42, and a holding arm 45 projects between each pair of front and rear locking arms 43, 44.

Figure 20:
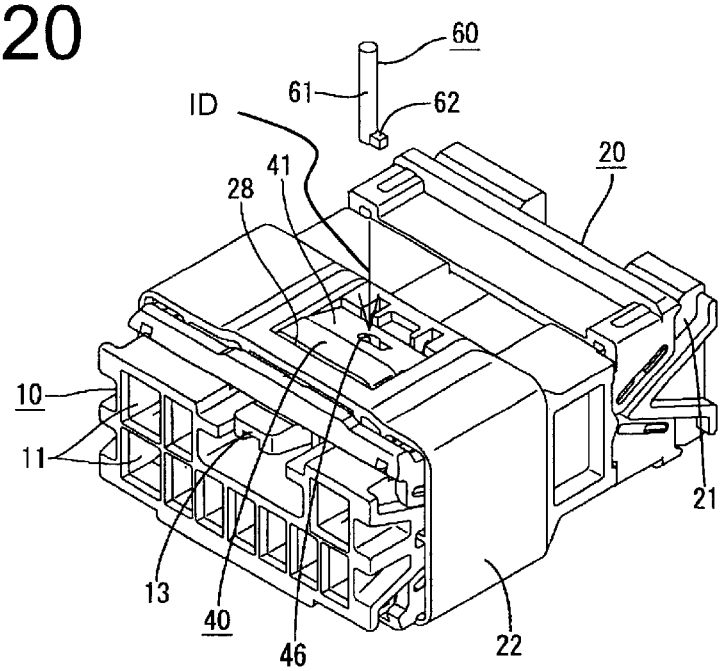
FIG. 20 is a perspective view showing a state before a disengaging jig is inserted into a disengagement hole.
Figure 21:
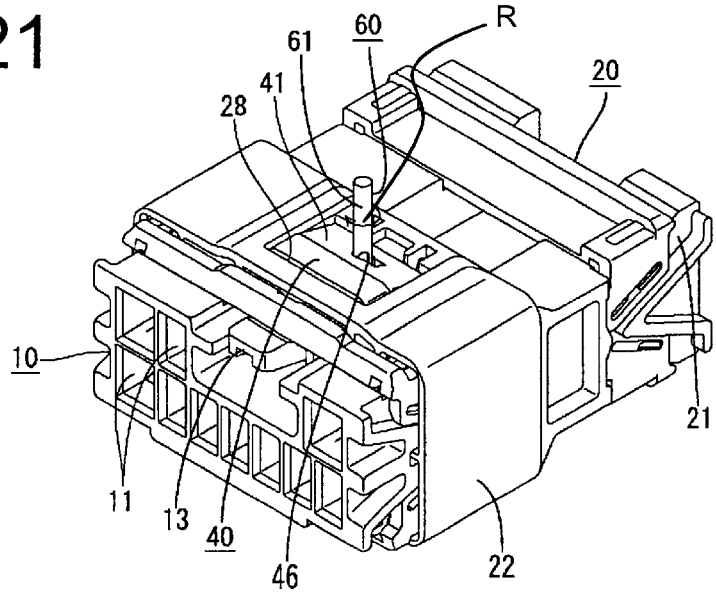
FIG. 21 is a perspective view showing an action of rotating the disengaging jig inserted into the disengagement hole.
Figure 22:
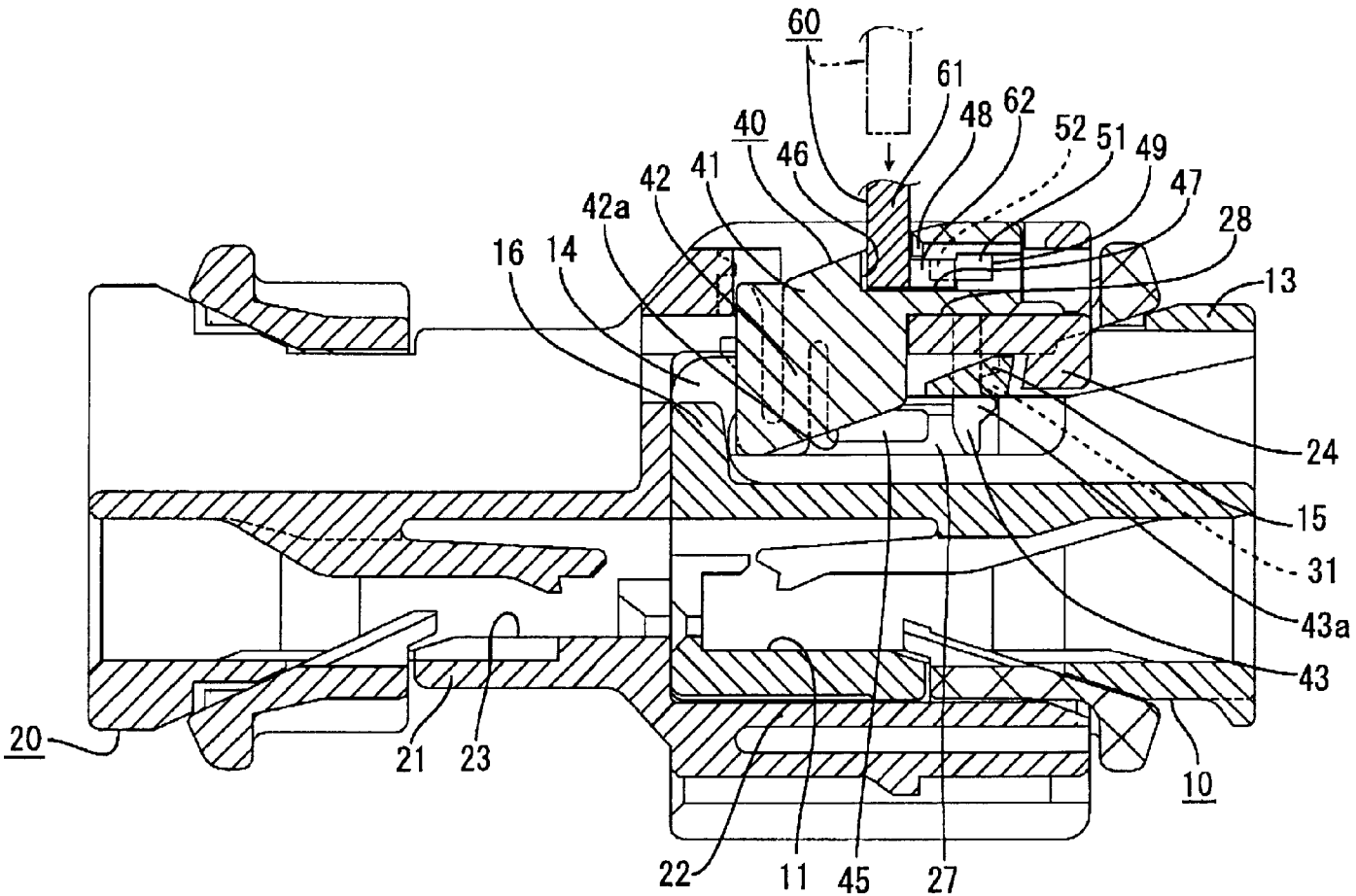
FIG. 22 is a side view in section showing an operation of catching a catchable portion by the disengaging portion.

A disengagement hole 46 is formed in the upper surface of the base 41, as shown in FIG. 20, and can receive a disengaging jig 60 for operating the detector 40 that has been fitted into the mount recess 28.

Figure 14:
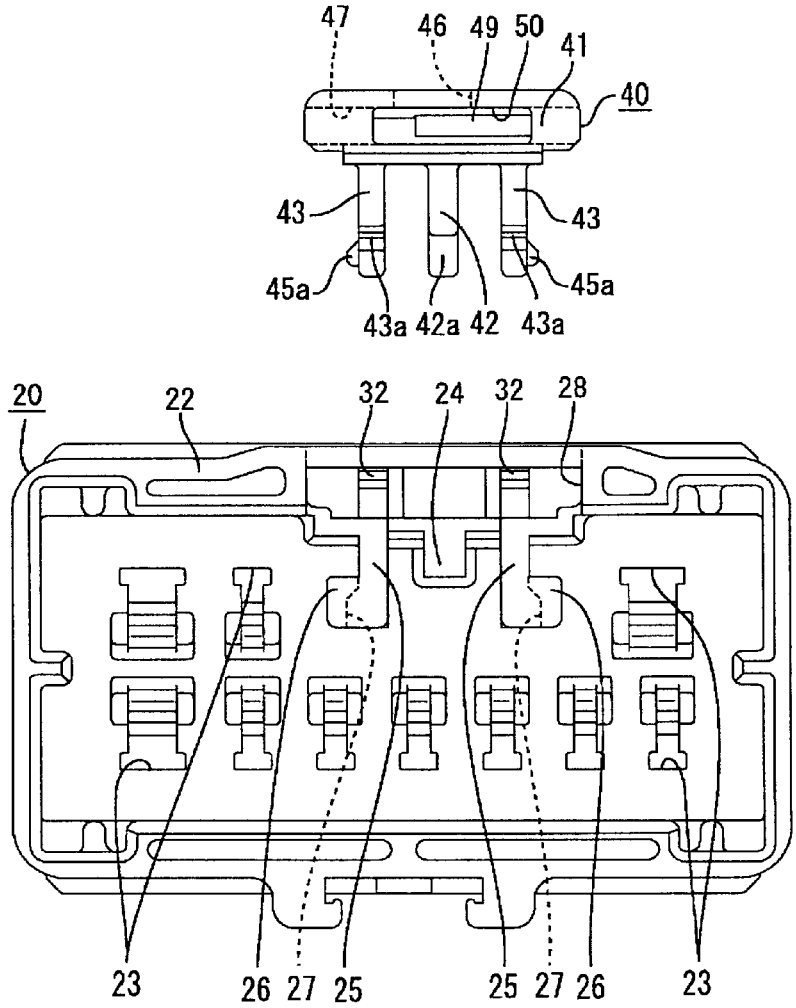
FIG. 14 is a front view of a male housing and a detector according to a further preferred embodiment of the invention.
Figure 15:
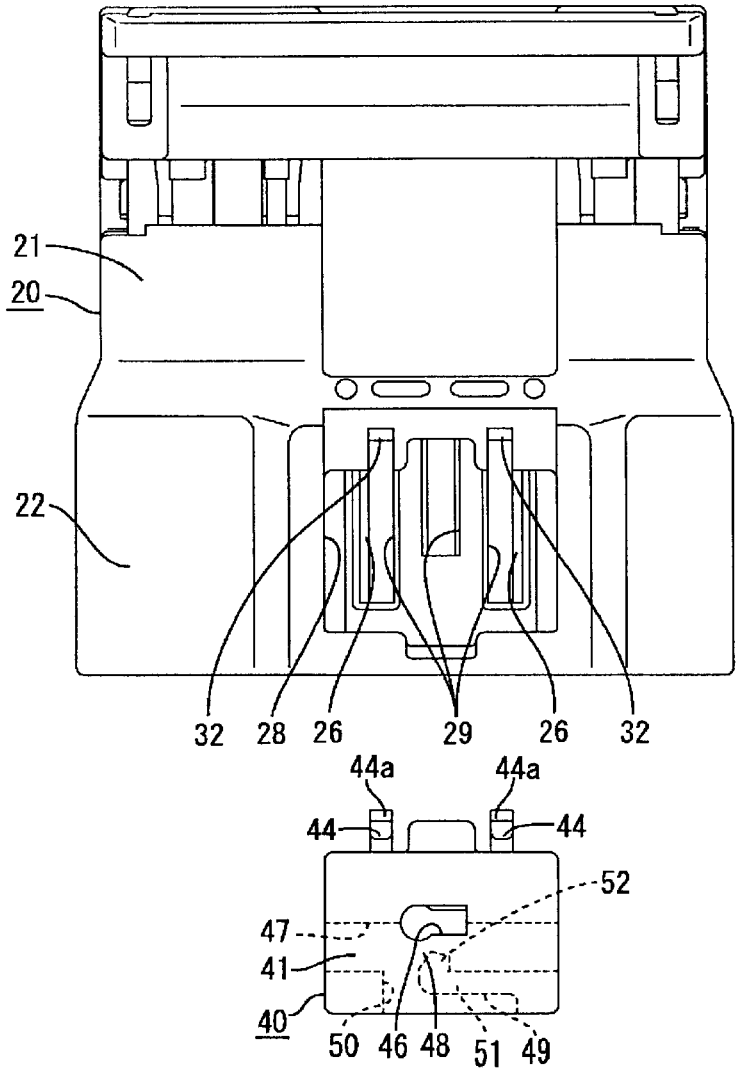
FIG. 15 is a plan view of the male housing and the detector.
Figure 16:
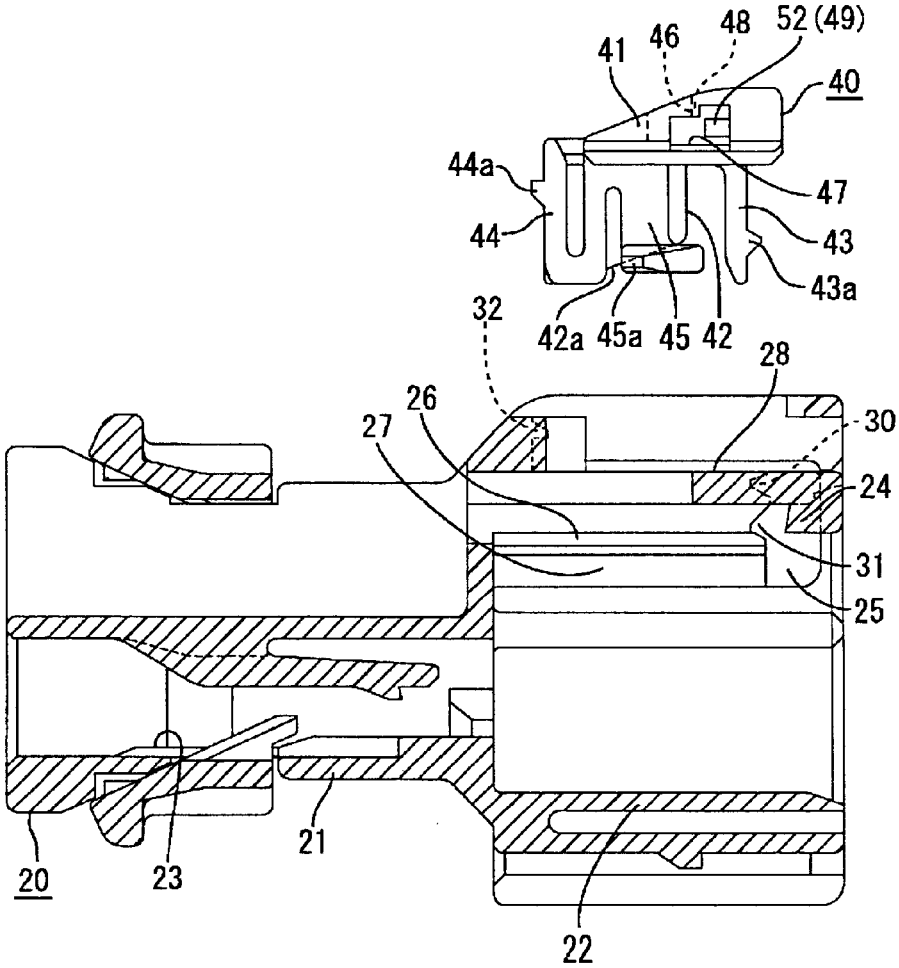
FIG. 16 is a side view in section of the male housing and the detector.
Figure 17:
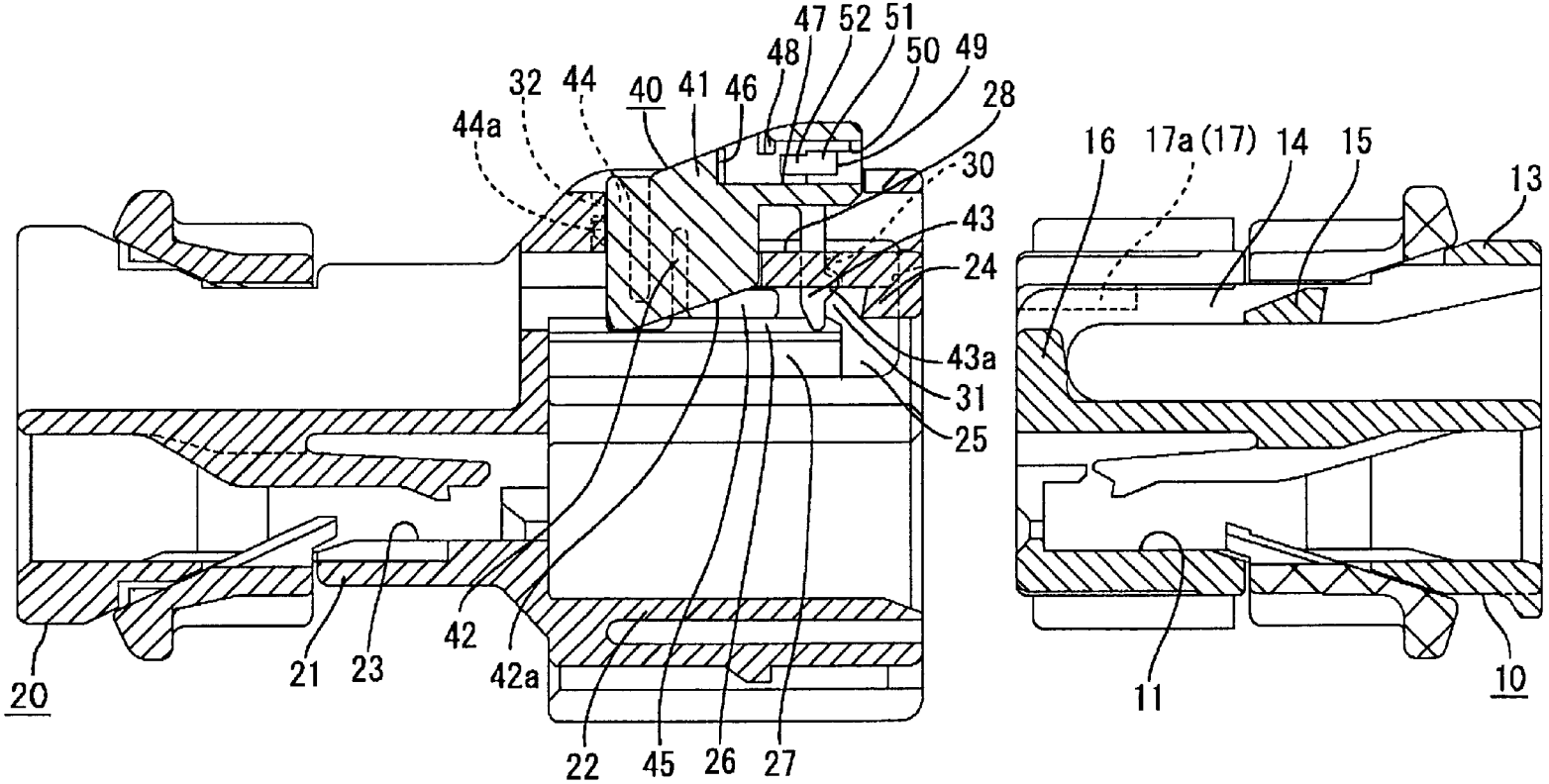
FIG. 17 is a side view in section of the male and female housings when the detector is mounted at an initial position.
Figure 18:
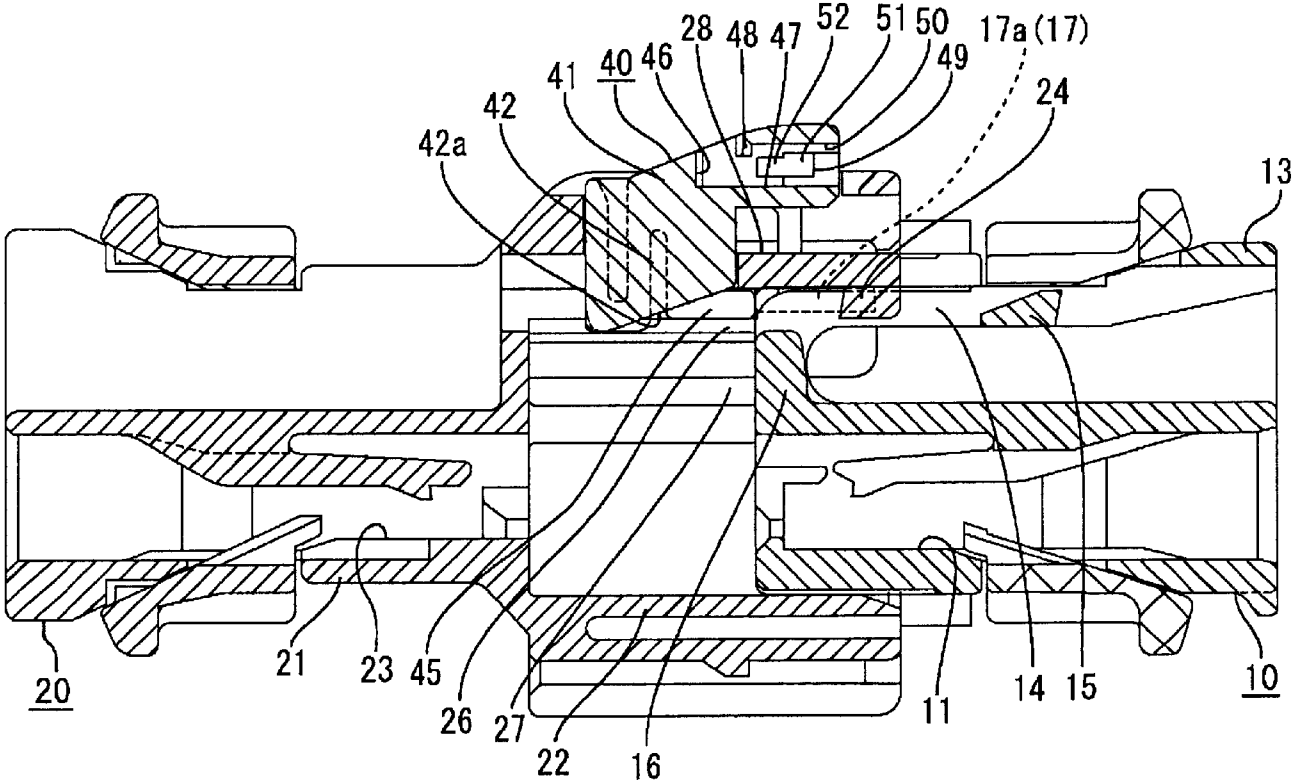
FIG. 18 is a side view in section showing an intermediate state of connection of the two housings.
Figure 19:
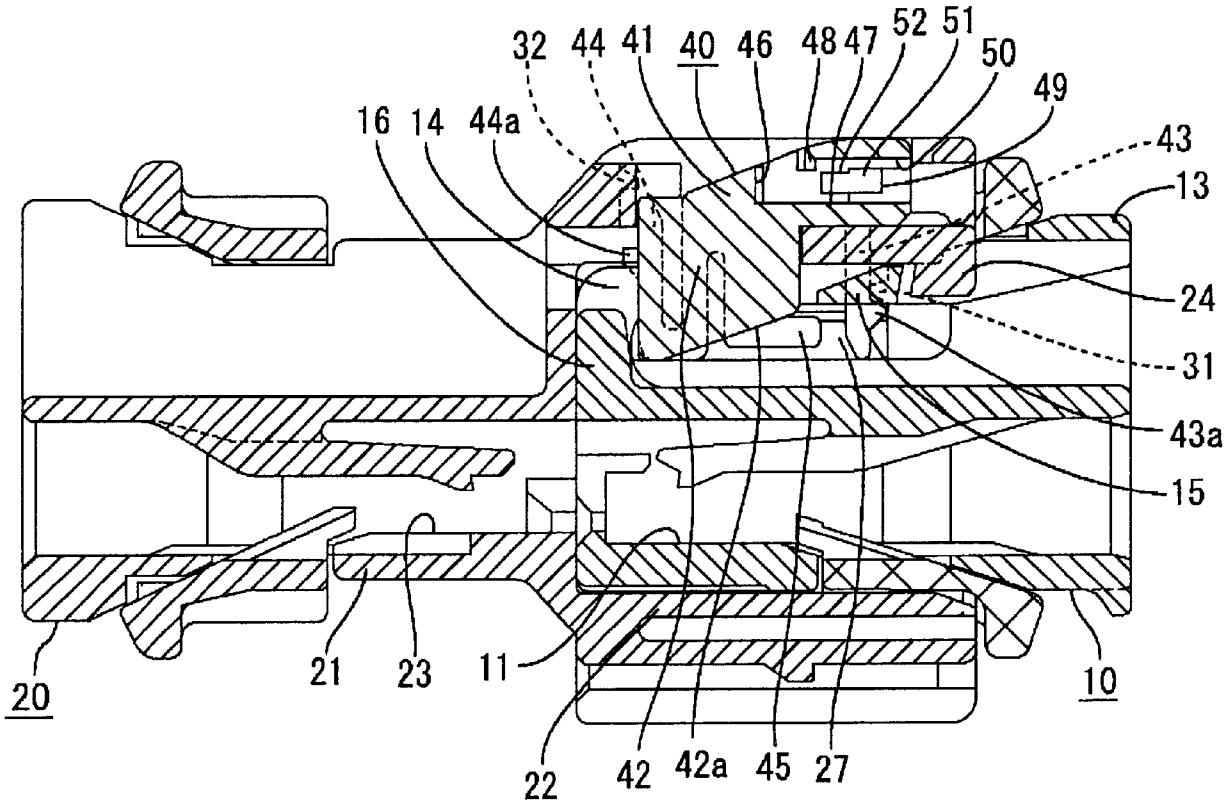
FIG. 19 is a side view in section showing the housings connected properly and the detecting member pushed to a detecting position.

The base 41 has a rotation permitting space 47 that communicates with the disengaging hole 46. The rotation permitting space 47 is an inverted L-shaped hole, as shown in FIG. 16, and penetrates transversely through the base 41, as shown in FIGS. 14 and 15. The bottom surface of the rotation permitting space 47 is substantially flush with the bottom surface of the disengagement hole 46 and the front half of the bottom of the disengagement hole 46 is included in the rotation permitting space 47. Thus, the disengaging portion 62 of the disengaging jig 60 can enter the disengagement hole 46 and can be advanced into contact with the bottom surface. The disengaging jig 60 then is rotated clockwise in direction R of FIG. 21 about a longitudinal axis of the shaft 61 so that the disengaging portion 62 rotates in the rotation permitting space 47 (see FIG. 22). The disengaging jig 60 then can be pulled up so that the upper surface of the disengaging portion 62 engages the catchable portion 48 defined at the front edge of the disengagement hole 46 facing into the rotation permitting space 47 for pulling the detector 40 up from the detecting position to the initial position (see FIG. 25).

Figure 23:
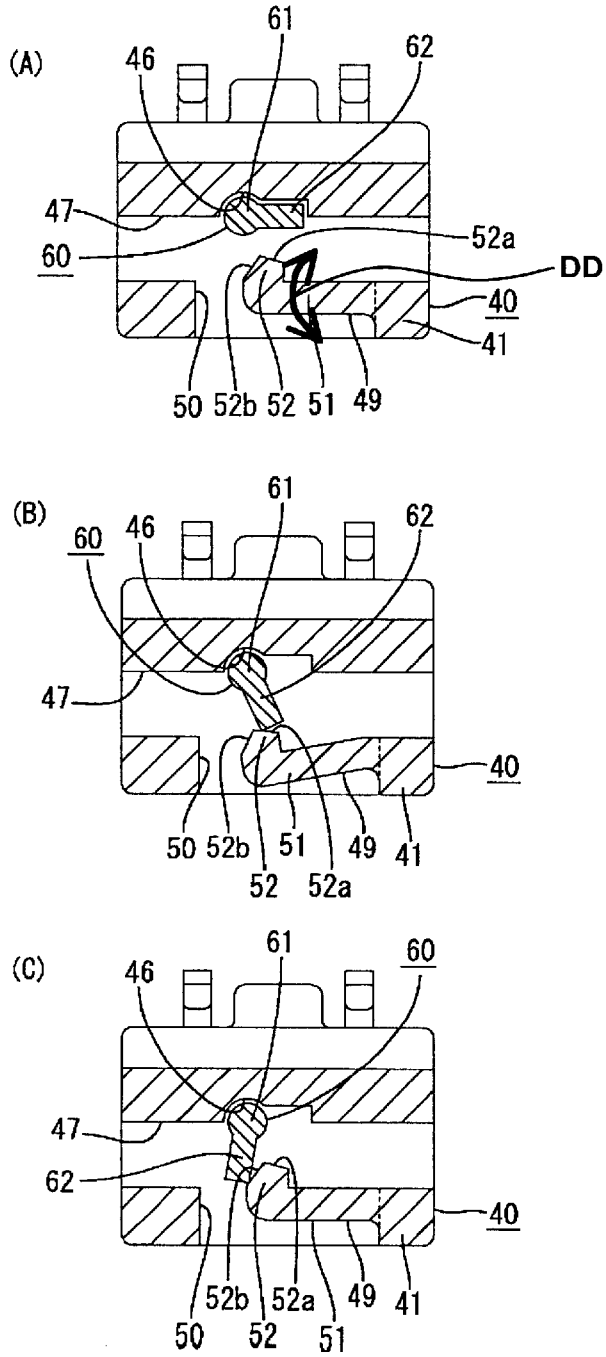
Figure 24:
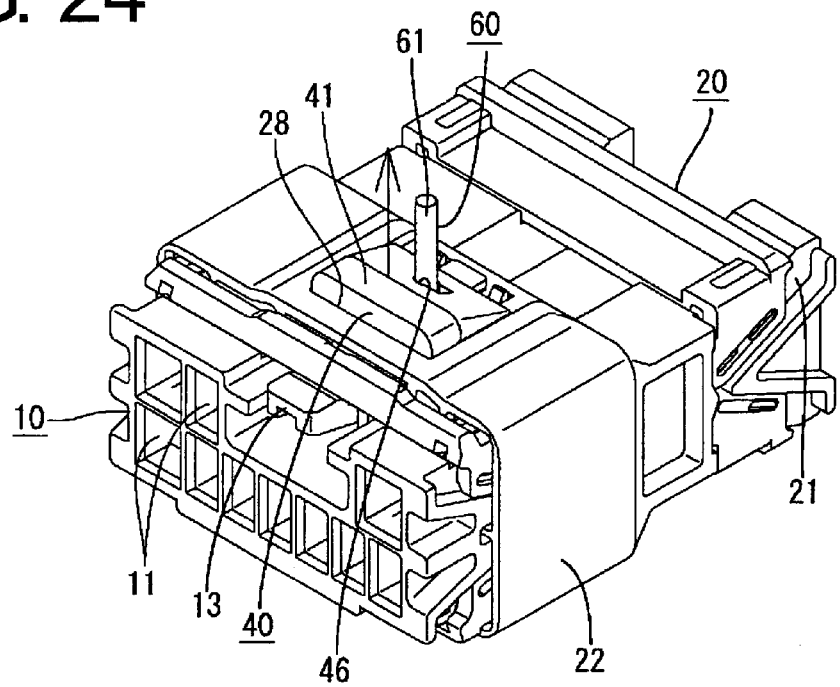
FIG. 24 is a perspective view showing a state where the detecting member is pulled up to the initial position by the disengaging jig.
Figure 25:
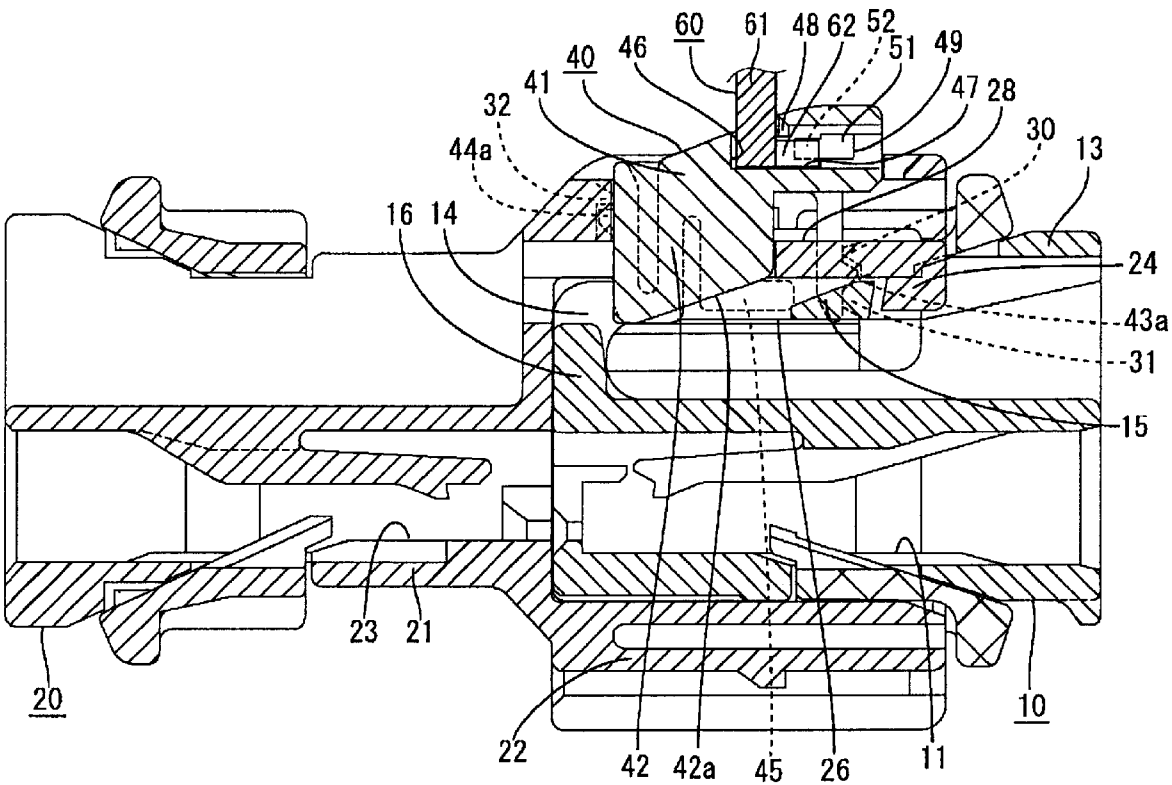
FIG. 25 is a side view in section showing the state where the detecting member is pulled up to the initial position by the disengaging jig.

A resilient lock 49 is cantilevered from the front wall of the rotation permitting space 47 of the base 41 for holding the disengaging jig 60 in a posture for the disengaging portion 62 to catch the catchable portion 48. A mold-removal hole 50 to remove the resilient lock 49 opens forward as shown in FIG. 23. This resilient lock 49 has a base at the right edge of the wall, and has an arm 51 extending along width direction. A locking projection 52 projects back from the rear of an extending end of the arm 51. The arm 51 is resiliently deformable along a deformation direction DD (e.g. substantially along forward and backward directions of the connector) and the rear surface of the arm 51 is flush with the front surface of the rotation permitting space 47.

The locking projection 52 projects into the rotation permitting space 47 and is arranged on or intersects a trace T of displacement of the disengaging portion 62 that results from the rotation of the disengaging jig 60. The disengaging portion 62 engages a slanted rear surface 52*a* of the locking projection 52 during rotation the disengaging jig 60 from the insertion position and resiliently deforms the arm 51 forward as the disengaging portion 62 rotates (see FIGS. 23(A), 23(B)). The disengaging portion 62 of the disengaging jig 60 is rotated slightly over 90° from the insertion position and is engageable with the slanted left surface 52*b* of the locking projection 52 (see FIG. 23(C). At this rotation position, the disengaging portion 62 can catch the catchable portion 48. The slanted left surface 52*b* gradually departs away from the disengaging portion 62 toward the rear end. Thus, a counterclockwise rotation of the disengaging jig 60 against the slanted surface 52*b* with a specified force or larger will deform the arm 51 resiliently forward and will disengage the locking projection 52 from the disengaging portion 62.

The detector 40 is moved by inserting the disengaging jig 60 into the disengaging hole 46, as shown in FIG. 9, until the leading end surface of the disengaging jig 60 contacts the bottom surface of the disengaging hole 46 (see FIGS. 11 and 12(A)). The disengaging jig 60 then is rotated clockwise about the longitudinal axis of the shaft 61 as shown in FIG. 10. Thus, the disengaging portion 62 rotates and enters the rotation permitting space 47, as shown in FIG. 11. This rotation causes the disengaging portion 62 to engage the slanted rear surface 52*a* of the locking projection 52, as shown in FIGS. 12(A) and 12(B). Thus, the arm 51 is deformed resiliently forward by the engagement of the rotating disengaging portion 62 with the slanted surface 52*a*. The disengaging jig 60 is rotated slightly over 90° from the insertion position. Thus, the disengaging portion 62 reaches the left side of the locking projection 52 and the arm 51 is restored resiliently towards its original shape as shown in FIG. 12(C). As a result, the disengaging portion 62 and the slanted surface 52*b* at the left side of the locking projection 52 engage resiliently. Thus, the disengaging jig 60 will rotate toward the insertion position only if subjected to a specified force or larger.

The disengaging portion 62 faces the catchable portion 48 at this stage. Thus, the disengaging jig 60 can be pulled up, and the upper surface of tire disengaging portion 62 will catch the catchable portion 48, as shown in FIGS. 13 and 14 so that the detector 40 can be pulled up to the initial position. The front locking arms 43 are deformed as the locking projections 43*a* move onto the front locking projections 31 at the lower side, and the holding arms 45 are deformed as the holding projections 45*a* move onto the rails 26. The resilient lock 49 holds the disengaging jig 60 rotationally when the detector 40 is pulled up, and hence operability is good. The engaging wall 42 is retracted to the non-interfering position above the interfering portion 16 when the detector 40 is retracted to the initial position. Thus, the lock arm 13 is deformed to disengage the lock 15 from the lock 24 and the housings 10, 20 can be pulled apart and detached from each other while. The resilient lock 49 locks the disengaging jig 60 to the detector 40 even when the housings 10, 20 are detached. Thus, the two can be handled together, and the disengaging jig 60 will not be lost during maintenance.

The housings 10, 20 are reconnected after maintenance in a manner similar to the above while the disengaging jig 60 remains inserted. The detector 40 is moved from the initial position to the detecting position by pushing the disengaging jig 60 down after the housings 10, 20 are connected. The disengaging jig 60 rotated in a disengaging direction, e.g. counterclockwise, after the detector 40 has been moved. This rotation causes the disengaging portion 62 to exert a pushing force on the slanted surface 52*b* of the locking projection 52 of a sufficient magnitude for the arm 51 to be deformed forward and to disengage the disengaging portion 62 and the locking projection 52 from each other. The disengaging jig 60 reaches the insertion position where the disengaging portion 62 aligns with the disengagement hole 46 and can be pulled out upward. In this way, the disengaging jig 60 can be held in the detector 40 during the reconnection process. Therefore, there is no danger of forgetting an operation of pushing the detector 40 to the detecting position at the time of reconnection.

The rotation permitting space 47 communicates with the bottom of the disengaging hole 46 along the shaft 61 of the disengaging jig 60 and the edge of the disengaging hole 46 facing the rotation permitting space 47 serves as the catchable portion 48. Thus, it is difficult to catch the catchable portion 48 using a usual tool with a straight shaft, such as a screwdriver, and a person who does not possess the special disengaging jig 60 is unlikely to inadvertently detach the connector. Further, the disengaging jig 60 cannot be taken out unless the power supply circuit is turned off. Therefore, the connector cannot be detached during the power application, and an arc can be prevented.

The resilient lock 49 holds the disengaging jig 60 such that the disengaging portion 62 catches the catchable portion 48, the detector 40 can be moved easily. Furthermore, a loss of the disengaging jig 60 between the detachment and the reconnection of the two connectors can be avoided. Further, the disengaging jig 60 can be held in the detector 40 at the time of reconnection, and an operation of moving the restricting member to engage the other connector housing will not be forgotten.

The resilient lock functions as a semi-locking mechanism 49 that holds the disengaging jig 60. Thus, both a holding force for holding the disengaging jig 60 and the operability of the disengaging jig 60 can be easily attained.

The disengaging portion 62 can catch the catchable portion 48 by rotating the disengaging jig 60. Thus, an opening area of the disengaging hole 46 can be made smaller as compared to a case where a slide groove continuous with the disengaging hole is formed and the catchable portion is caught by the disengaging portion by sliding the disengaging jig.

The invention is not limited to the above described and illustrated embodiment. For example, following embodiments are also embraced by the technical scope of the present invention as defined by the claims. Beside the following embodiments, various changes can be made without departing from the scope and spirit of the invention as defined by the claims.

The resilient lock is supported at one end in the foregoing embodiment, but may be supported at its both ends.

The semi-locking mechanism for resiliently locking the disengaging jig by the resilient lock is described in the foregoing embodiment. Besides this, a holder may be formed separately from the detector may be mounted in the detector to hold the disengaging jig in a state where the disengaging portion catches the catchable portion.

The disengaging hole has such a shape obtained by connecting round and rectangular portions as to conform to the shape of the disengaging jig in the foregoing embodiment. However, the disengaging hole may have a conforming star-shaped cross section if, for example, the disengaging jig has a star-shaped cross section by having five protuberances on the outer circumferential surface of the shaft. The shape of the disengaging hole may not necessarily conform to that of the disengaging jig. In other words, the disengaging hole can take any shape provided that the disengaging jig is insertable into the disengaging hole that has the edge to serve as the catchable portion.

Although the disengaging jig is rotated in the foregoing embodiment, a slide groove may, for example, be continuous with the disengaging hole and the disengaging jig inserted into the disengaging hole may be slid to catch a catchable portion at the edge of the slide groove by the disengaging portion. Such an embodiment is also embraced by the present invention.

The disengaging jig is accommodated in the connector for turning the power supply on and off in the foregoing embodiment. However, it may be accommodated in a junction box for turning a power supply on and off.

Although the detector is mounted in the male housing in the foregoing embodiment, it may also be mounted in the female housing.

What is claimed is:

1. A connector, comprising:

first and second housings (20, 10) engageable with each other, the first housing (20) being formed with a recess (28) in a side surface thereof;

a restricting member (40) mounted in the recess (28) of the first housing (20) and engageable with the second housing (10) to prevent separation of the housings (10, 20) that have been engaged properly with each other, the restricting member (40) being formed with a disengagement hole (46), a displacement permitting space (47) communicating with the disengagement hole (46), and a catchable portion (48) facing into the displacement permitting space (47); and a disengaging jig (60) having a shaft (61) and a disengaging portion (62) projecting transversely from the shaft (61), the disengaging portion (62) being dimensioned for insertion through the disengagement hole (46) and into the displacement permitting space (47), the disengaging portion being rotatable with the shaft (61) so that the disengaging portion (62) catches the catchable portion (48) for moving the restricting member (40).

2. The connector of claim 1, wherein the disengaging portion (62) bulges out sideways from a leading end of the shaft (61).

3. The connector of claim 1, wherein the displacement permitting space (47) communicates with a bottom portion of the disengagement hole (46).

4. The connector of claim 1, wherein the displacement permitting space (47) is formed to permit displacement of the disengaging portion (62) due to the rotation of the disengaging jig (60) inserted into the disengagement hole (46).

5. The connector of claim 1, wherein the catchable portion (48) is formed by an edge of the disengagement hole (46).

6. The connector of claim 1, further comprising a holding means (49) for holding the disengaging jig (60) in a posture where the disengaging portion (62) catches the catchable portion (48).

7. The connector of claim 6, wherein the holding means (49) comprises a resilient lock (49) arranged on a trace (T) of displacement of the disengaging portion (62) in the displacement permitting space (47), the holding means being resiliently engageable with the disengaging portion (62).

8. The connector of claim 7, wherein the resilient lock (49) is resiliently deformable only when a pushing force of at least a specified magnitude is given from the disengaging portion (62).

9. The connector of claim 8, wherein the holding means (49) comprises a guiding means (49A; 49B) for guiding an interaction with the disengaging portion (62).

10. The connector of claim 9, wherein the guiding means (49A; 49B) comprises a slanted surface (49A; 49B) disposed for engagement by the disengaging portion (62) during displacement of the disengaging portion (62).

11. A method of disengaging first and second housings (20, 10) of a connector, wherein a restricting member (40) is mounted into the first housing (20) for engaging the second housing (10) to prevent separation of the housings (10, 20) that have been engaged properly with each other, comprising the steps of:

inserting a disengaging jig (60) having a disengaging portion (62) bulging out sideways from a shaft (61) into a disengagement hole (46) formed in the restricting member (40), displacing the disengagement portion (62) within a displacement permitting space (47) that communicates with the disengagement hole (46), and engaging the disengaging portion (62) with a catchable portion (48) of the restricting member (40) that faces the displacement permitting space (47) for moving the restricting member (40) to a separation permitting position where the housings (10, 20) can be disengaged.

12. The method of claim 11, wherein the disengaging portion (62) is displaced by rotating the disengaging jig (60) inserted into the disengagement hole (46).

13. The method of claim 12, wherein the disengaging jig (60) is held in a posture such that the disengaging portion (62) catches the catchable portion (48).

14. The connector of claim 13, wherein the disengaging jig (60) is held by resiliently engaging the disengaging portion (62) with a resilient lock (49) arranged on a trace (T) of displacement of the disengaging portion (62) in the displacement permitting space (47).

* * * * *